US006809476B2

(12) United States Patent
Lee et al.

(10) Patent No.: US 6,809,476 B2
(45) Date of Patent: Oct. 26, 2004

(54) PLASMA DISPLAY PANEL AND METHOD FOR FABRICATING THE SAME

(75) Inventors: Mi Kyoung Lee, Kyongsangbuk-do (KR); Kui Sung Shin, Seoul (KR)

(73) Assignee: LG Electronics Inc., Seoul (KR)

( * ) Notice: Subject to any disclaimer, the term of this patent is extended or adjusted under 35 U.S.C. 154(b) by 180 days.

(21) Appl. No.: 09/994,838

(22) Filed: Nov. 28, 2001

(65) Prior Publication Data

US 2002/0063522 A1 May 30, 2002

(30) Foreign Application Priority Data

Nov. 29, 2000 (KR) ..... 2000-71689

(51) Int. Cl.[7] ..... H01J 17/00; H01J 61/00

(52) U.S. Cl. ..... 313/581; 313/495; 445/24; 445/25

(58) Field of Search ..... 313/581–587, 313/495–497, 605, 634; 445/24, 25; 156/106

(56) References Cited

U.S. PATENT DOCUMENTS 5,600,203 A * 2/1997 Namikawa et al. ..... 313/495
6,129,603 A * 10/2000 Sun et al. ..... 445/25
6,479,944 B2 * 11/2002 Lee et al. ..... 315/169.4
6,545,410 B1 * 4/2003 Wu et al. ..... 313/582

FOREIGN PATENT DOCUMENTS

| | | |
|---|---|---|
| JP | 09-251839 | 9/1997 |
| JP | 10-021832 | 1/1998 |
| JP | 10-326572 | 12/1998 |
| JP | 11-079768 | 3/1999 |
| JP | 11-317169 | 11/1999 |

* cited by examiner

*Primary Examiner*—David V. Bruce
*Assistant Examiner*—Elizabeth Keaney
(74) *Attorney, Agent, or Firm*—Fleshner & Kim, LLP

(57) ABSTRACT

A plasma display panel and a method for fabricating the same are disclosed, in which the fabricating process time of the plasma display panel can be reduced, characteristic and performance of the panel can be prevented from being reduced, and the panel can be prevented from being damaged. Also, a panel structure is not changed by external pressure variation. The method for fabricating a plasma display panel includes the steps of: depositing a first adhesive along a predetermined area outside an active picture of a first substrate; depositing a second adhesive outside a portion where the first adhesive is deposited, to have a predetermined interval from the first adhesive; depositing a sealant to align with upper portions of the first and second adhesives; depositing an adhesive outside a portion where the second adhesive is deposited, to have a predetermined interval from the second adhesive; aligning a second substrate on the first substrate; and attaching the first and second substrates to each other under a predetermined pressure.

10 Claims, 7 Drawing Sheets

PLASMA DISPLAY PANEL AND METHOD FOR FABRICATING THE SAME

This application claims the benefit of the Korean Application No. P2000-71689 filed on Nov. 29, 2000, which is hereby incorporated by reference.

BACKGROUND OF THE INVENTION

1. Field of the Invention

The present invention relates to a plasma display panel, and more particularly, to a plasma display panel and a method for fabricating the same.

2. Discussion of the Related Art

In accordance with the advent of the multimedia era, a display device that can display a natural color has been required. Particularly, a plasma display panel has lately attracted considerable attention an advanced display device because a current cathode ray tube (CRT) or a liquid crystal display (LCD) has limitations in realizing a large sized display of 40 inch or greater.

A typical plasma display panel, as shown in FIGS. 1A and 1B, includes an upper substrate 10 and a lower substrate 20 which face each other. FIG. 1C illustrates a sectional structure of the plasma display panel, in which the lower substrate 20 is rotated by 90° for the convenience.

The upper substrate 10 includes scan electrodes 16 and 16', sustain electrodes 17 and 17', a dielectric layer 11, and a passivation layer 12. The scan electrodes 16 and 16' are formed in parallel to the sustain electrodes 17 and 17'. The dielectric layer 11 and the passivation layer 12 are sequentially formed on the upper substrate 10 including the scan electrodes 16 and 16' and the sustain electrodes 17 and 17'.

The lower substrate 20 includes address electrodes 22, a dielectric layer 21, barriers 23, and a phosphor 24. The dielectric layer 21 is formed on an entire surface of the lower substrate including the address electrodes 22. The barriers 23 are formed on the dielectric layer 21 between the respective address electrodes 22. The phosphor 24 is formed on surfaces of the barriers 23 and the dielectric layer 21 in each discharge cell.

Inert gases such as He and Xe are mixed in a space between the upper substrate 10 and the lower substrate 20. The space forms a discharge area.

The operation of the aforementioned plasma display panel will now be described.

If a driving voltage is applied between each address electrode and each scan electrode, opposite discharge occurs between the address electrode 22 and the scan electrodes 16 and 16'. Some electrons emitted from the inert gas within the discharge cell come into collision with a surface of the passivation layer due to the opposite discharge. The collision of the electrons secondarily emits electrons from the surface of the passivation layer. The secondarily emitted electrons come into collision with a plasma gas to diffuse the discharge. If the opposite discharge between the address electrode 22 and the scan electrode 16 and 16' ends, wall charges having opposite polarities occur on the surface of the passivation layer on the respective address and scan electrodes.

If the discharge voltages having opposite polarities are continuously applied to the scan electrodes 16 and 16' and the sustain electrodes 17 and 17' and at the same time the driving voltage applied to the address electrode 22 is cut off, area discharge occurs in a discharge area on the surfaces of the dielectric layer and the passivation layer due to the potential difference between the scan electrodes 16 and 16' and the sustain electrodes 17 and 17'. The electrons in the discharge cell come into collision with the inert gas in the discharge cell due to the opposite discharge and the area discharge. As a result, the inert gas in the discharge cell is excited and ultraviolet rays having a wavelength of 147 nm occur in the discharge cell. The ultraviolet rays come into collision with the phosphors surrounding the address electrode and the barriers, so that the ultraviolet rays are emitted, thereby displaying a picture image.

Therefore, to obtain an improved performance and a longer life span, the plasma display panel should have rigid internal films and no mixed gases except for the discharge gases.

A method for fabricating the aforementioned plasma display panel includes three fabricating processes such as a prior process, a later process, and a module process.

In the prior process, various films are formed in the upper and lower substrates 10 and 20. In the later process, attachment of the upper and lower substrates 10 and 20, exhaust, injection of a discharge gas, tip-off, aging, and test are implemented. The tip-off is implemented in such a manner that exhaust and injection of a discharge gas are implemented through an exhaust pipe and then the exhaust gas is cut and sealed. The aging is to apply a power source to an electrode, drive the panel for a predetermined time, and finally remove impurities, thereby obtaining a discharge voltage drop effect.

Finally, in the module process, a circuit is mounted and assembled to complete the plasma display panel.

The method for fabricating the related art plasma display panel will now be described with reference to FIGS. 2A to 2C.

As shown in FIGS. 2A to 2C, the upper and lower substrates 10 and 20 are fed to the attachment equipment, and a sealant 30, i.e., frit is deposited along a boundary of the upper or lower substrate using a dispenser. The frit consists of glass, $SiO_2$, and an additive for improving adhesion.

The upper and lower substrates are dried at a temperature of about 120° C. and fired at a high temperature of 400° C. or greater to remove the impurities remaining in the frit.

The fired upper and lower substrates are fed to the attachment equipment in a state that the upper substrate 10 is exposed to the air.

As shown in FIG. 2B, the upper substrate 10 and the lower substrate 20 are aligned in the attachment equipment and then fixed by a nipper 50 for attachment. Then, the frit is fused, so that the upper substrate 10 and the lower substrate 20 are attached to each other as shown in FIG. 2C.

Also, a long straw shaped exhaust pipe 40 of glass is attached to an exhaust hole (not shown) of the lower substrate 20 using a frit ring (not shown) during the attachment process.

Next, the attached substrates are fed to an exhaust and gas injection equipment. The exhaust and gas injection equipment exhausts out mixtures stuck to the film and mixed gases generated in the film using the exhaust pipe 40 under high vacuum and heating conditions.

The discharge gas is injected through the exhaust gas 40 and heat is applied to the end of the exhaust gas 40 so as not to leak the injected discharge gas, thereby melting the end of the exhaust gas 40 to implement the tip-off process.

Then, the aging is carried out and then the status of the panel is tested. Thus, the process of fabricating the plasma display panel is completed.

As described above, in the exhaust pipe type fabrication equipment, a separate type fabrication equipment separately carries out the attachment process, the exhaust process, and the gas injection process. The separate type fabrication equipment includes an attachment equipment and an exhaust and gas injection equipment. The exhaust and gas injection equipment includes a hot blast furnace (not shown) for forming exhaust and discharge gas injection conditions, and a cart (not shown) for loading a panel (not shown), carrying out exhaust and discharge gas injection within the hot blast furnace, and unloading the panel.

The cart has a complex structure that includes a vacuum pump (not shown) putting the panel under vacuum state, a vacuum pipe system consisting of an exhaust manifold (not shown), a valve and a pipe arrangement, a discharge gas injection bombe (not shown), a gas injection pipe system consisting of a gas injection manifold (not shown), a valve and a pipe arrangement, and a tip-off unit (not shown) for implementing tip-off of the exhaust pipe 40.

However, the method for fabricating the related art plasma display panel has several problems.

First, the firing process carried out to remove impurities of the frit increases power consumption due to its heating and cooling functions. Also, since a large quantity of impurities are generated from the frit due to high heat applied during the attachment process, the exhaust time increases. Further, since the frit is susceptible to external impact, crack of the panel is caused during the external impact.

Moreover, since high heat is applied under high vacuum state during the attachment process, high load is applied to the panel made of glass fragile to thermal deviation and tensile strength, thereby damaging the panel and reducing characteristic of the panel.

SUMMARY OF THE INVENTION

Accordingly, the present invention is directed to a plasma display panel and a method for fabricating the same that substantially obviates one or more problems due to limitations and disadvantages of the related art.

An object of the present invention is to provide a plasma display panel and a method for fabricating the same in which an attachment process is carried out at a room temperature so as not to generate mixed gases, thereby reducing the fabricating process time of the plasma display panel and preventing characteristic and performance of the panel from being reduced and also preventing the panel from being damaged.

Another object of the present invention is to provide a plasma display panel and a method for fabricating the same in which a panel structure is not changed by external pressure variation.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a plasma display panel includes: a first substrate; a first adhesive deposited along a predetermined area outside an active picture of a first substrate; a second adhesive deposited outside a portion where the first adhesive is deposited, to have a predetermined interval from the first adhesive; a sealant deposited to align with upper portions of the first and second adhesives; an adhesive deposited outside a portion where the second adhesive is deposited, to have a predetermined interval from the second adhesive; and a second substrate aligned on the first substrate in a state where it is adhered to surfaces of the sealant and the adhesive.

In another aspect of the present invention, a method for fabricating a plasma display panel includes the steps of: depositing a first adhesive along a predetermined area outside an active picture of a first substrate; depositing a second adhesive outside a portion where the first adhesive is deposited, to have a predetermined interval from the first adhesive; depositing a sealant to align with upper portions of the first and second adhesives; depositing an adhesive outside a portion where the second adhesive is deposited, to have a predetermined interval from the second adhesive; aligning a second substrate on the first substrate; and attaching the first and second substrates to each other under a predetermined pressure.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

A process of fabricating a plasma display panel will be described with reference to FIGS. 3A to 3E.

Figure 1A:
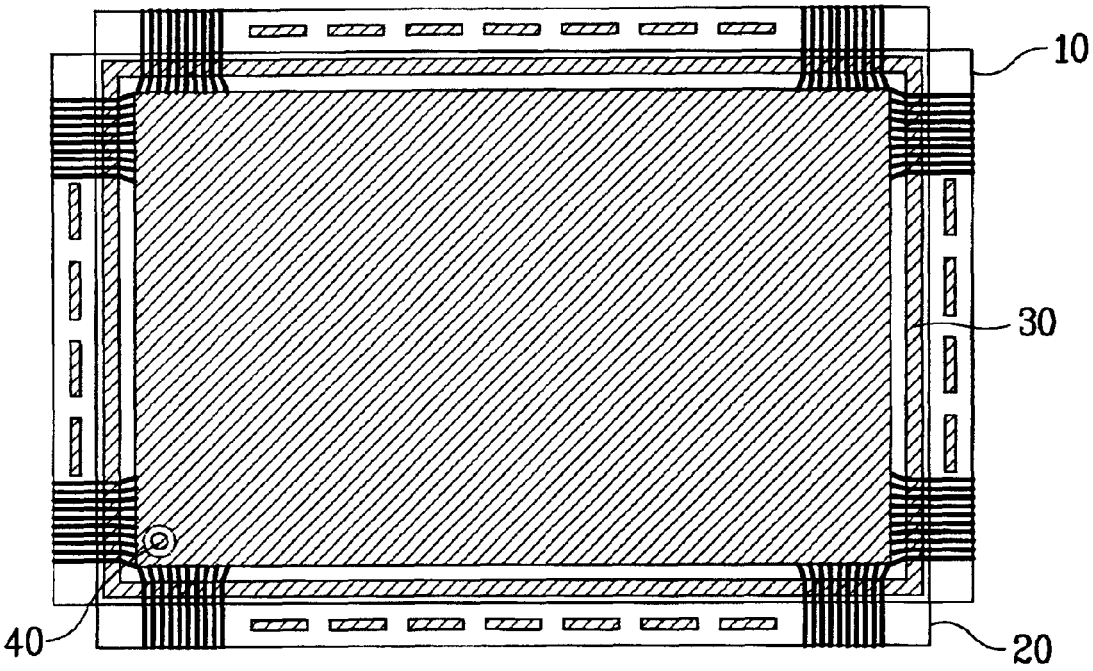
FIG.1A Related Art
FIG. 1A is a plane view illustrating a structure of a typical plasma display panel.
Figure 1B:
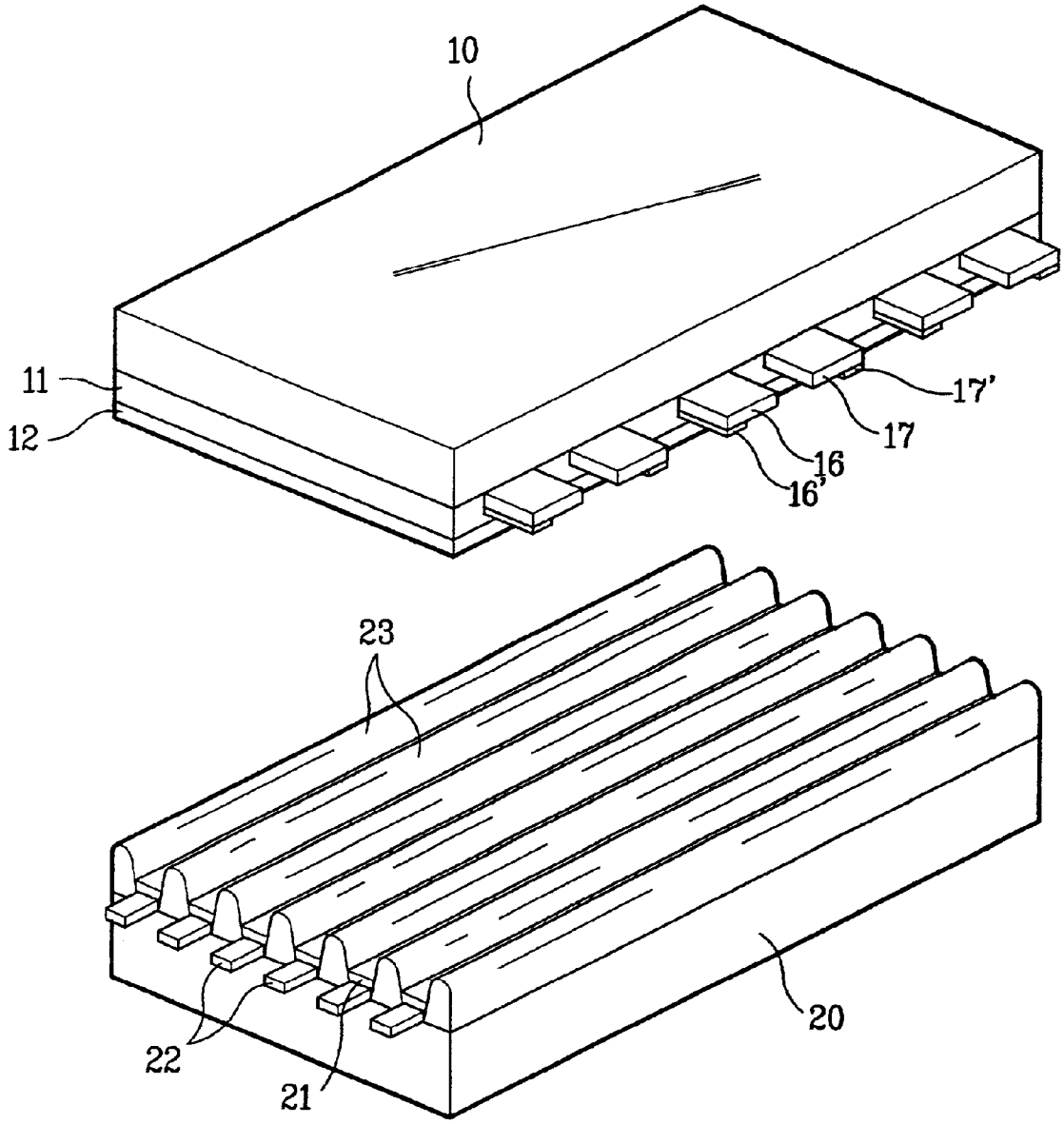
FIG.1B Related Art
FIGS. 1B and 1C are perspective views illustrating a structure of a typical plasma display panel.
Figure 1C:
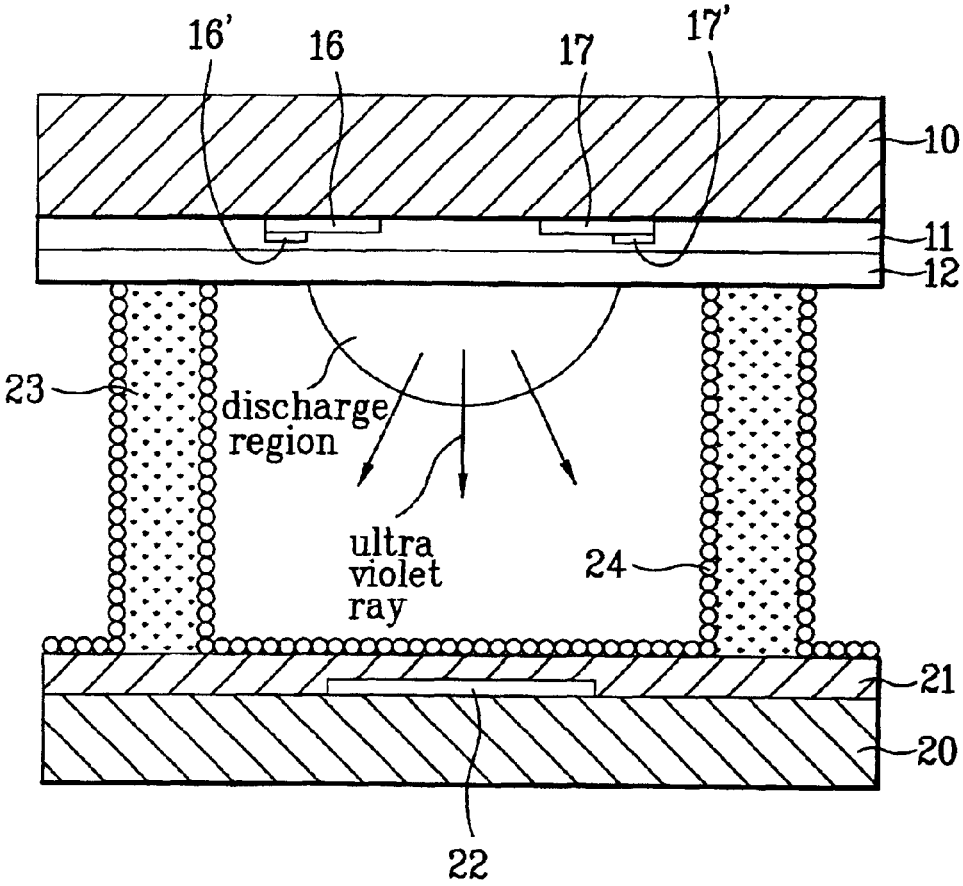
FIG.1C Related Art
Figure 2A:
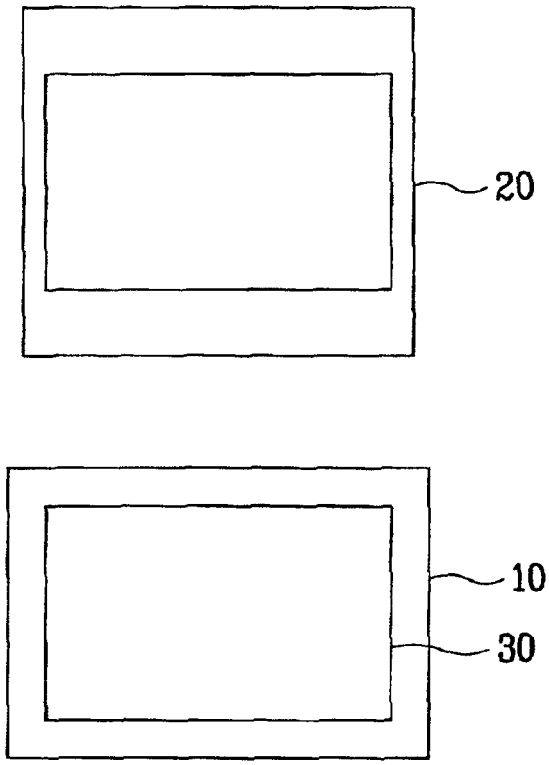
FIG.2A Related Art
FIGS. 2A to 2D are sectional views illustrating an attachment process of a related art plasma display panel.
Figure 2B:
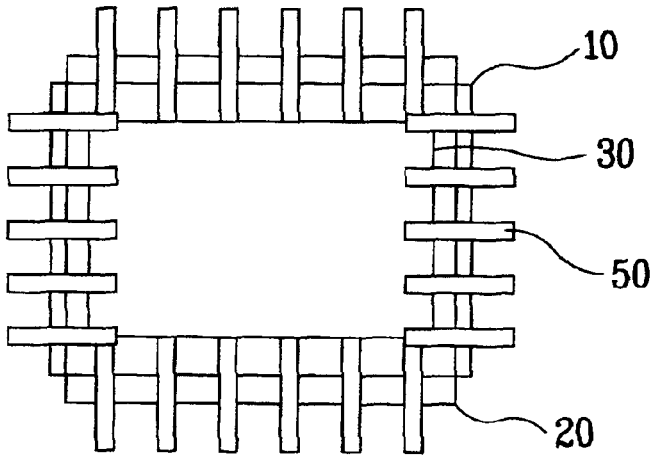
FIG.2B Related Art
Figure 2C:
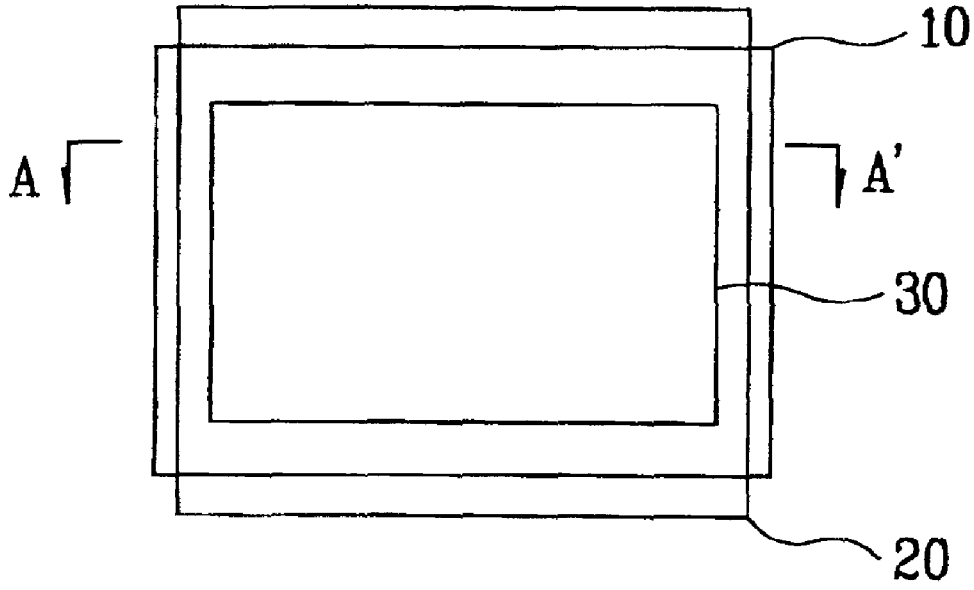
FIG.2C Related Art
Figure 2D:
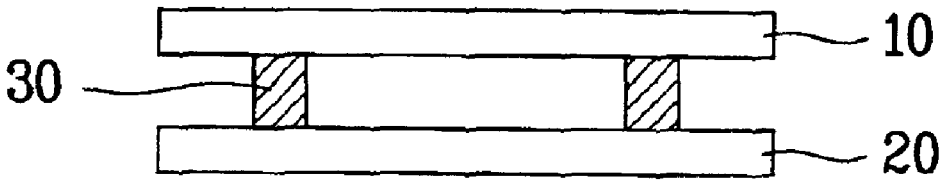
FIG.2D Related Art
Figure 3A:
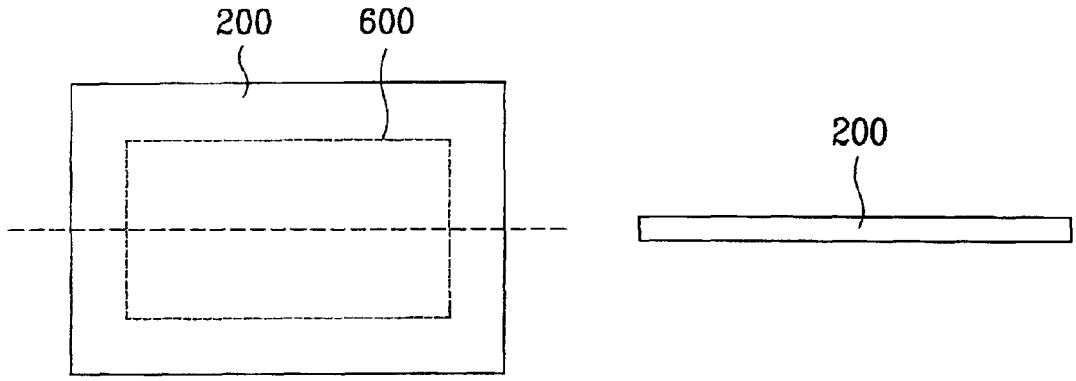
FIGS. 3A to 3E are sectional views illustrating a process of fabricating a plasma display panel according to the present invention.
Figure 3B:
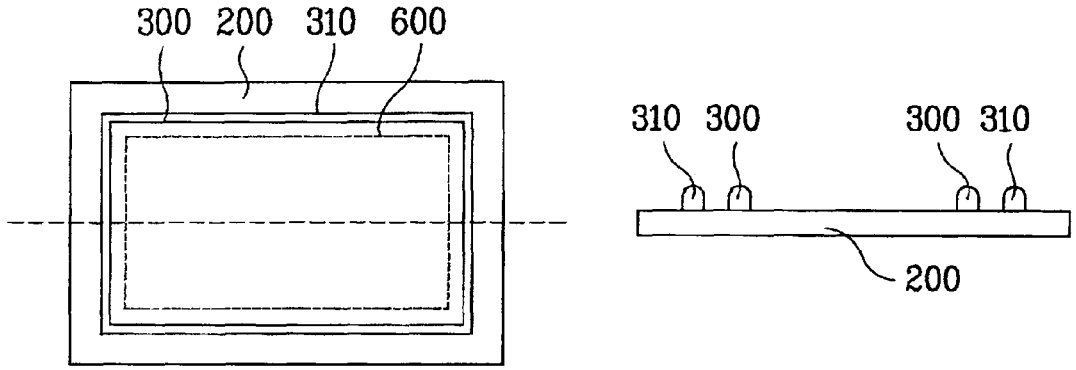

A rib is formed on a lower substrate 200 of FIG. 3A using first and second adhesives 300 and 310 by a screen printing method used when forming barriers. In other words, the first adhesive 300 is deposited along a predetermined region outside an active picture of the lower substrate 200, and then the second adhesive 310 is deposited, at a predetermined interval from the first adhesive, outside a portion where the first adhesive 300 is deposited.

The first and second adhesives 300 and 310 are made of the same material as each other and are not deformed by pressure applied when the upper substrate 100 and the lower substrate 200 are attached to each other. The first and second adhesives 300 and 310 should be lower than the barriers.

Figure 3C:
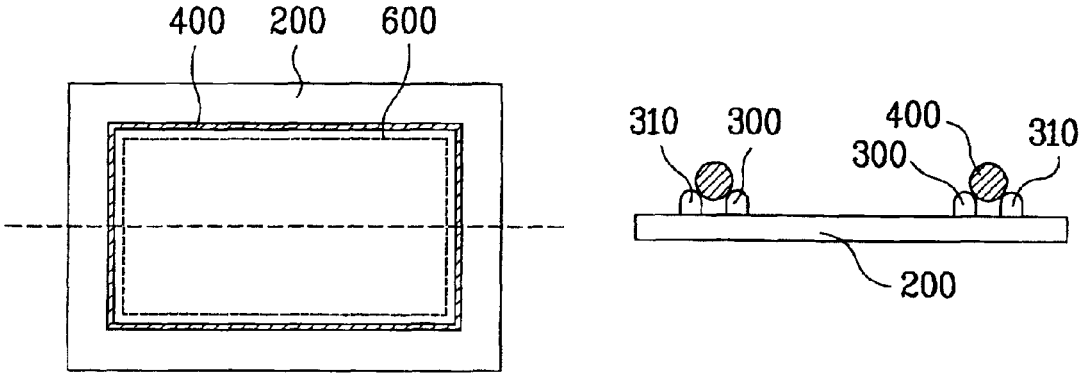

As shown in FIG. 3C, a sealant 400 is deposited to align with upper portions of the first and second adhesives 300 and 310 deposited on the lower substrate 200. The sealant 400 is made of an elastomer based material having a characteristic deformed by attachment pressure.

At this time, the elastomer based sealant 400 is of a rubber material unlike frit which is the existing sealant. The sealant 400 has characteristics having no mixed gas exhausted according to heating or pressurization and constant resiliency that can endure external impact.

Figure 3D:
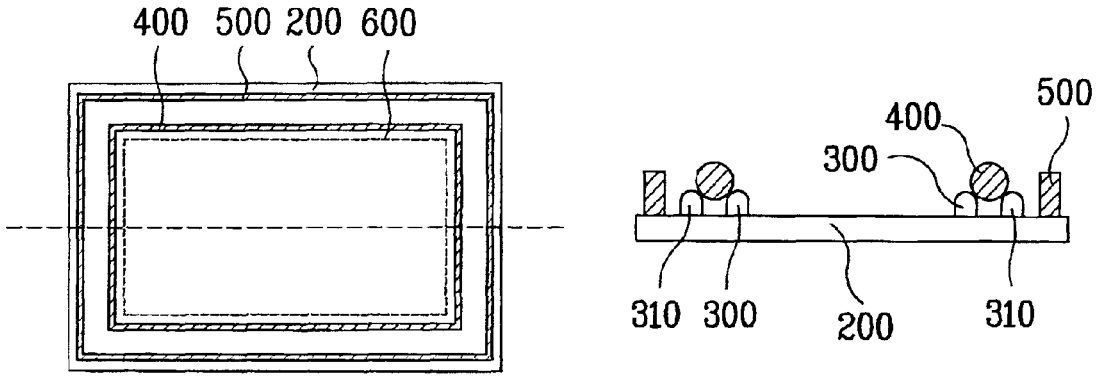

As shown in FIG. 3D, an adhesive 500 is deposited at a predetermined interval along an outer wall of the second adhesive 310 deposited on the lower substrate 200. The adhesive 500 is an auxiliary pressure applying means that attaches the upper substrate 100 to the lower substrate 200. Also, the adhesive 500 can be congealed quickly at a room temperature and can pressurize the sealant 400. A material that can endure condensation/tension is used as the adhesive 500.

Figure 3E:
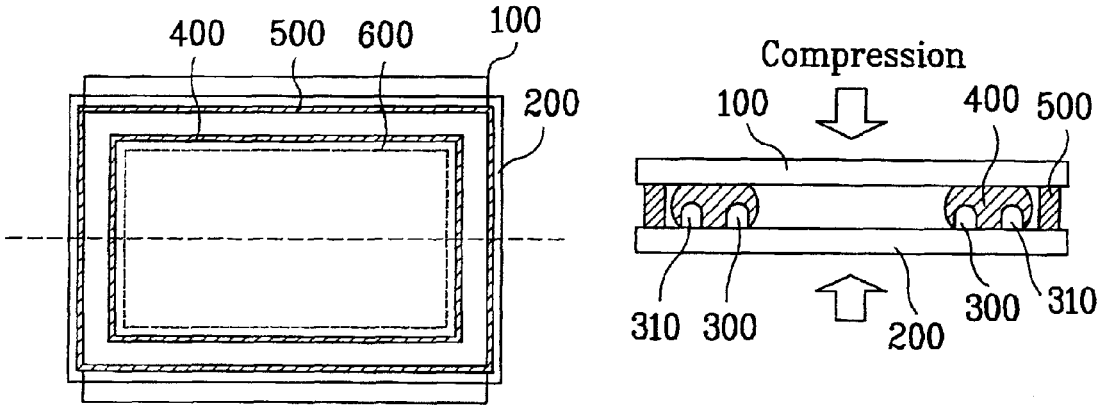

Subsequently, as shown in FIG. 3E, the upper substrate 100 and the lower substrate 200 are precisely aligned with each other and then attached to each other by a predetermined pressure.

The attachment of the upper and lower substrates 100 and 200 is completed as the adhesive 500 is congealed.

In other words, the barriers are formed in the upper and lower substrates 100 and 200 using the adhesive when the upper substrate 100 is attached to the lower substrate 200. Accordingly, the elastomer based sealant 400 can be aligned desirably by the barriers and is deformed by the attachment pressure to obtain an improved vacuum effect and provide a structural supporting power in response to a pressure difference between the inside of the panel and its outside, thereby preventing any deformation of the panel from occurring.

Furthermore, since the fabricating and attachment processes according to the present invention are carried out at a room temperature, heating and cooling processes are not required after the upper substrate 100 is attached to the lower substrate 200 by fusing the frit, unlike the related art. Accordingly, energy loss can be avoided and the process time can be reduced.

The plasma display panel according to the present invention includes a first substrate 200, a first adhesive 300 deposited along a predetermined area outside an active picture of the first substrate 200, a second adhesive 310 deposited outside a portion where the first adhesive 300 is deposited, to have a predetermined interval from the first adhesive 300, a sealant 400 deposited to align with upper portions of the first and second adhesives 300 and 310, an adhesive 500 deposited outside a portion where the second adhesive 310 is deposited, to have a predetermined interval from the second adhesive 310, and a second substrate 100 aligned above the first substrate 200 in a state where it is adhered to surfaces of the sealant 400 and the adhesive 500.

The method for fabricating the plasma display panel according to the present invention has the following advantages.

First, since the upper substrate is attached to the lower substrate at a room temperature, load applied to the panel is small so that characteristic of the panel can be prevented from being deteriorated, unlike the related art high temperature/high pressure conditions. Also, heating and cooling processes are not required, thereby minimizing energy loss.

Furthermore, since an elastomer based rubber is used as the sealant instead of a glass based sealant, mixed gases are not generated, thereby preventing the characteristic of the panel from being deteriorated and also preventing the panel from being damaged.

Finally, since the barriers are formed to align the elastomer of the lower substrate and generate the structural supporting power, the sealing power due to vacuum can be improved, and sliding between the adhesive and the glass substrate can be avoided when the upper substrate and the lower substrate are attached to each other, thereby enabling a structural position alignment.

It will be apparent to those skilled in the art than various modifications and variations can be made in the present invention. Thus, it is intended that the present invention covers the modifications and variations of this invention provided they come within the scope of the appended claims and their equivalents.

What is claimed is:

1. A method for fabricating a plasma display panel comprising:

depositing a first adhesive along a predetermined area outside an active picture of a first substrate;

depositing a second adhesive outside a portion where the first adhesive is deposited, to have a predetermined interval from the first adhesive;

depositing a sealant to align with upper portions of the first and second adhesives;

depositing a third adhesive outside a portion where the second adhesive is deposited, to have a predetermined interval from the second adhesive;

aligning a second substrate on the first substrate; and attaching the first and second substrates to each other via the sealant and the third adhesive, under a predetermined pressure.

2. The method of claim 1, wherein the first and second adhesives are made of the same material as each other.

3. The method of claim 1, wherein the first and second adhesives are made of a material that is not deformed by an attachment pressure.

4. The method of claim 1, wherein the sealant is made of a material deformed by the attachment pressure.

5. The method of claim 1, wherein the sealant is an elastomer based material.

6. The method of claim 1, wherein all the steps are carried out at a room temperature.

7. A plasma display panel comprising:

a first substrate;

a first adhesive deposited along a predetermined area outside an active picture of a first substrate;

a second adhesive deposited outside a portion where the first adhesive is deposited, to have a predetermined interval from the first adhesive;

a sealant deposited to align with upper portions of the first and second adhesives;

a third adhesive deposited outside a portion where the second adhesive is deposited, to have a predetermined interval from the second adhesive; and a second substrate aligned on the first substrate in a state where it is adhered to surfaces of the sealant and the third adhesive.

8. The plasma display panel of claim 7, wherein the first and second adhesives are made of the same material as each other.

9. The plasma display panel of claim 7, wherein the sealant is made of a material deformed by an attachment pressure.

10. The plasma display panel of claim 7, wherein the sealant is an elastomer based material.

* * * * *